United States Patent [19]

Loggins

[11] Patent Number: 4,999,922

[45] Date of Patent: Mar. 19, 1991

[54] RULED MULTI-PURPOSE DRAFTING INSTRUMENT

[75] Inventor: C. Jim Loggins, Sheboygan, Wis.

[73] Assignee: Mayline Company, Inc., Sheboygan, Wis.

[21] Appl. No.: 290,700

[22] Filed: Dec. 27, 1988

[51] Int. Cl.[5] ..... B43L 7/00

[52] U.S. Cl. ..... 33/474; 33/480

[58] Field of Search ..... 33/429, 474, 476, 479, 33/480, 482, 489

[56] References Cited

U.S. PATENT DOCUMENTS

| | | | |
|---|---|---|---|
| D. 136,091 | 8/1943 | Tripp | 33/474 X |
| 343,616 | 6/1986 | Upson et al. | 33/474 |
| 1,523,919 | 1/1925 | Vitek et al. | 33/474 |
| 2,364,529 | 12/1944 | Hill | 33/474 |

FOREIGN PATENT DOCUMENTS

| | | | |
|---|---|---|---|
| 730763 | 5/1932 | France | 33/480 |
| 1385756 | 12/1964 | France | 33/474 |
| 386883 | 1/1933 | United Kingdom | 33/480 |

*Primary Examiner*—Harry N. Haroian

*Attorney, Agent, or Firm*—Ronald B. Sefrna

[57] ABSTRACT

The present invention discloses a multi-purpose drafting instrument adapted to combine the functions of drafting triangles and commonly used drafting scales. The drafting instrument of the invention generally comprises an L-shaped integrally formed substantially planar construction having two legs of equal length and width disposed perpendicular to each other. The end of each leg is inclined at an angle of 45 degrees relative the outer edge of each leg, the upper face of each leg is beveled at its inner edge to provide a thin working edge, and a ruled scale is provided on the lower face of each leg at its inner edge. The drafting instrument also includes a plurality of glide points extending outwardly from the lower face of the instrument to support the instrument slightly above the surface upon which it is used, and a handle disposed near the intersection of the two legs of the instrument to facilitate its use.

4 Claims, 2 Drawing Sheets

RULED MULTI-PURPOSE DRAFTING INSTRUMENT

FIELD OF THE INvENTION

The present invention generally relates to the field of drafting instruments, and more particularly relates to an L-shaped drafting instrument intended primarily for use with a T-square or horizontal bar, establishing limited contact between the instrument and the drafting surface, and including ruled drafting scales and a handle convenient for grasping with the fingers of the user.

BACKGROUND OF THE INVENTION

The two most common operations in the practice of drafting are the scribing of lines of specific lengths along the horizontal and vertical axes of the drafting work or drawing being created. A horizontal line of a certain length is generally produced by first marking the end point of the line on the drafting work with the use of a drafting scale or ruler, and then scribing the line along the working edge of a T-square or horizontal bar. Similarly, a vertical line of a certain length is generally produced by placing a triangle on the T-square or horizontal bar to create the vertical axis, marking the end point of the vertical line with the use of a drafting scale held along the edge of the triangle, and then scribing the line along the working edge of the triangle. Similar steps are normally required to produce lines at an angle, such as 45 degrees, from the horizontal or vertical axes of the drafting work. While these methods are effective, they suffer the disadvantage of inefficiency resulting from the need to use more than one instrument, and to move back and forth from one instrument to the other to complete the operation.

The use of standard drafting triangles and T-squares or horizontal bars introduces additional disadvantages arising from the full contact between the relatively extensive surface area of the face of the triangles and the drawing surface, which tends to produce smearing of the work, and from obstruction of the work by normally opaque areas of the commonly used drafting tools. The full surface contact between drafting triangles and the drawing surface also gives rise to problems with graphite and eraser residue accumulations under the triangles and between the triangle edge and the T-square or horizontal bar.

Various approaches to solution of these problems have been attempted and are known in the prior art, but none of the approaches have fully addressed the combination of problems, and none have presented a coordinated solution. L-shaped drafting instruments are known in the art, as illustrated by British Patent No. 386,883 and French Patent No. 730,763, both of which include beveled edges and some form of graduated scale. Those instruments do not, however, address the problems of extensive contact with the drawing surface or of residue buildup.

French Patent No. 1,385,756 discloses the use of raised points on the face of a T-square or triangle to raise the instrument above the surface of the drafting work, which does alleviate certain of the normal disadvantages of the use of a triangular instrument, but the design stops short of a coordinated solution to the full scope of problems associated with a triangular instrument and to the inefficiencies of the use of more than one instrument to produce lines of specific lengths. The use of a handle extending outwardly from at least one face of a drafting instrument has also been previously proposed, as in U.S. Pat. No. 831,314, U.S. Pat. No. 699,738, and U.S. Pat. No. 2,364,529. These designs are useful in providing a means of more readily grasping the drafting instrument with which they are used, but again do not address the full scope of problems.

It is an object of the present invention to provide a fully coordinated and highly efficient instrument for the production of lines of specific lengths, while addressing and overcoming the disadvantages associated with the commonly used forms of drafting instruments.

SUMMARY OF THE INVENTION

The drafting instrument of the invention generally comprises an L-shaped integrally formed substantially planar transparent body having two legs of equal length and equal width, disposed in perpendicular relation to each other. The end of each leg is inclined at an angle of 45 degrees relative to the outer, or long, edge of such leg. The upper face of the body of the instrument is beveled along the inner edge of each leg to form a thin working edge, and a graduated ruled scale is provided at the beveled edge of each leg. In the preferred embodiment of the invention the graduations along the inner edges of the two legs are different, arranged to provide two commonly needed drafting scales.

The body of the instrument includes a plurality of small glide points extending outwardly from the planar face of the lower surface of the body, for the purpose of supporting the instrument on the drafting surface and minimizing the surface area of contact between the body of the instrument and the drafting surface. In the preferred embodiment of the invention, those glide points are integrally formed with the body of the instrument and each is configured as a hemisphere. In the preferred embodiment the number of such glide points is three, selected to be the minimum number of such points consistent with stability, in order to further the aim of minimal surface area contact between the body of the instrument and the drafting surface. The glide points serve to reduce the friction associated with sliding of the instrument on the drafting surface in order to achieve the smoothest possible movement of the instrument and to substantially eliminate smearing of the drafting work, as well as to raise the planar lower face of the body of the instrument above the drafting surface in order to prevent build-up of graphite and eraser residue along the edges of the instrument.

The instrument of the invention further includes a handle extending outwardly from the upper face of the body of the instrument at a position near the intersection of the two legs of the body, to facilitate movement and control of the instrument during use. The handle may be of any configuration, cross-sectional dimension, and length consistent with convenient and efficient use.

The body of the drafting instrument of the invention is preferably constructed of a transparent plastic material suitable for forming by a molding process, and the scales provided along the inner edges of the two legs of the instrument are preferably transparent between the gradations or rulings of each scale. The transparency of the instrument substantially eliminates any visual obstruction of the drafting work and allows the draftsman to work with the least degree of wasted motion.

Each separate structural feature of the drafting instrument of the invention provides certain discrete efficiencies in use of the instrument, and such features are synergistic in combination, providing a highly efficient multi-purpose instrument for the performance of drafting work. The inclusion of commonly used drafting scales in combination with the beveled edges of the legs of the instrument allow a draftsman to lay out and scribe lines without the need to change back and forth between two separate instruments. The reduced surface area of the instrument in comparison with a standard triangle and the raising of the instrument above the drafting surface on the integral glide points not only facilitates movement and eliminates residue build-up problems, but also essentially eliminates the smearing of ink or graphite over the drafting work. The use of glide points also allows any edge of the instrument to be used as a working edge for the application of ink as well as graphite, since the tendency of ink to flow between the lower face of a drafting instrument and the drafting surface by capillary action is eliminated. As a result, there is no need for the instrument to be reversed from one face to the other during its use, and the draftsman can eliminate that inefficient motion. The inclined ends and equal length of the two legs allows the instrument to be rotated 180 degrees on the drafting surface and used in the same manner as a 45 degree triangle with the additional efficiencies of ruled edges and reduced surface contact.

The structure of the drafting instrument of the invention will now be described in detail, with reference to the accompanying drawing figures.

DETAILED DESCRIPTION OF THE INVENTION

Figure 1:
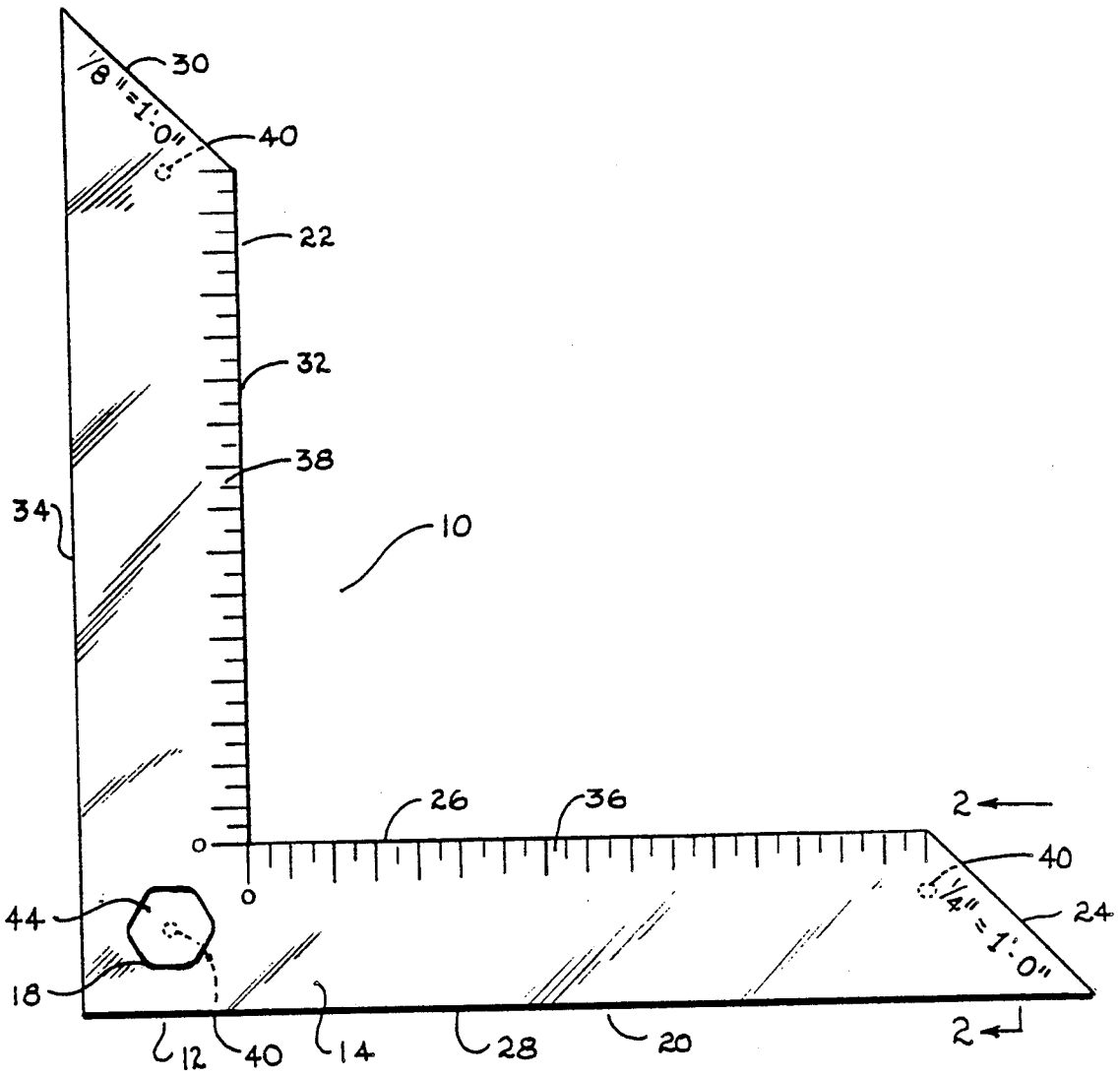
FIG. 1 is a plan view of the preferred embodiment of the drafting instrument of the invention.

With reference to the three accompanying drawing figures, the drafting instrument of the invention, generally designated by reference numeral 10, is shown to comprise an L-shaped substantially planar body 12 having an upper face 14 and a lower face 16, and a handle 18 extending outwardly from upper face 16 with the longitudinal axis of handle 18 perpendicular to the plane of body 12. Body 12 includes a first leg 20 and a second leg 22, of equal width and length, disposed in perpendicular relationship to each other. First leg 20 includes outer end 24, inner edge 26, and outer edge 28, and second leg 22 similarly includes outer end 30, inner edge 32, and outer edge 34. Outer end 24 of first leg 20 is inclined at an angle of 45 degrees relative to outer edge 28 of first leg 20, and outer end 30 of second leg 22 is inclined at an angle of 45 degrees relative to outer edge 34 of second leg 22.

Figure 2:
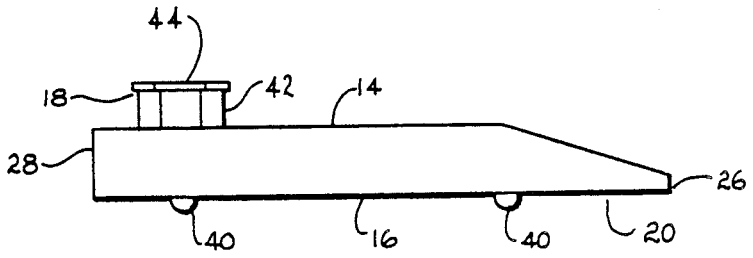
FIG. 2 is a cross-sectioned elevation view of the preferred embodiment of the drafting instrument of the invention along line 2—2 of FIG. 1.
Figure 3:
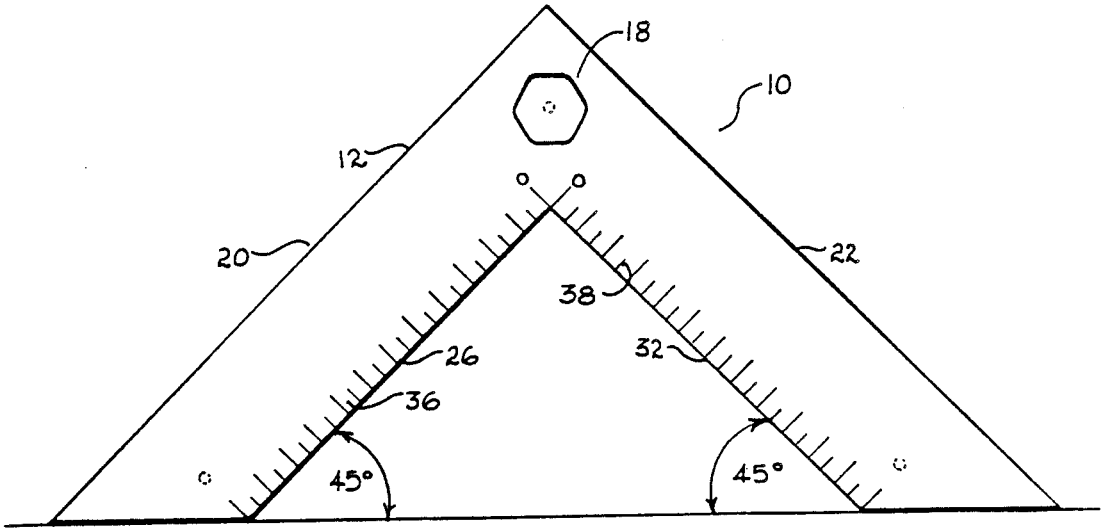
FIG. 3 is a plan view of the preferred embodiment of the drafting instrument of the invention, inverted upon a horizontal surface, such as the edge of a horizontal bar, to form 45 degree angles to the horizontal.

Lower face 16 of body 12 is planar throughout body 12. Upper face 14 of body 12 is beveled at inner edges 26 and 32 of legs 20 and 22, respectively, such that the thickness of each leg increases linearly from a minimum at the inner edge of each leg across the width of each leg to a maximum thickness intermediate the inner edge and the outer edge of each leg, as illustrated for first leg 20 in FIG. 2. In the preferred embodiment of instrument 10, the bevel extends through approximately one third of the width of each leg of body 12, but any convenient and useful proportion may be used. A ruled scale 36 is provided along the beveled portion of first leg 20 at inner edge 26, and another ruled scale 38 is provided along the beveled portion of second leg 22 at inner edge 32, with the zero points of the two scales coinciding at the right angle intersection of inner edges 26 and 32 of legs 20 and 22, respectively. In the preferred embodiment of instrument 10, scales 36 and 38 are two different commonly used drafting scales, such as one quarter inch equals one foot for scale 36 and one eighth inch equals one foot, for scale 38, for example, but any scales convenient for a particular use of instrument 10 may be supplied. In the preferred embodiment, each of scales 36 and 38 are formed by incising a shallow groove perpendicular to the inner edge of each respective leg for each graduation mark of each scale, and filling those shallow grooves with a colored ink stain or similar material. However, any other convenient method of forming such scales consistent with minimal obstruction of visibility through body 12 may be used.

Body 12 of instrument 10 further includes a plurality of glide points 40 disposed on and extending outwardly from lower face 16 a short distance, for the purpose of raising lower face 16 above the drafting surface. In the preferred embodiment of instrument 10, each of glide points 40 is configured as a hemisphere with a radius of approximately one sixteenth inch, and is integrally formed with body 12, but any convenient configuration, size, and means of interconnection consistent with the invention may be used. In the preferred embodiment the total number of glide points 40 is three, the minimum number consistent with maintaining the stability of instrument 10 upon a drafting surface, with one such glide point disposed under handle 18, one near outer end 24 of first leg 20, and one near outer end 30 of second leg 22.

Handle 18 of the preferred embodiment of instrument 10 comprises shaft 42, interconnected at its first end to body 12, and end cap 44 interconnected to the second end of shaft 42 concentric therewith. In the preferred embodiment of instrument 10 both shaft 42 and end cap 44 are hexagonal in cross-section, but any convenient configuration which allows handle 18 to be readily grasped with the fingers of the user may be used.

Body 12 of instrument 10, including glide points 40, is preferably formed as a one piece molded construction of a relatively hard transparent plastic material suitable for use in a molding process, such as an acrylic or polycarbonate plastic. The graduations or rulings of scales 36 and 38 may be separately formed as described above, or may by formed during the molding process. Handle 18 may be integrally formed with body 12, or may be separately formed and interconnected to body 12 in any convenient conventional manner. Handle 18 may be formed of the same material as body 12, or may be formed of another material, with or without the addition of coloring agents, if separately interconnected to body 12.

Instrument 10 is used to simultaneously measure and scribe horizontal and vertical lines by placing one of outer edges 28 or 34 along an edge of a T-square or drafting horizontal bar and using one of inner edges 26 or 32 to measure and scribe the desired line in either graphite or ink. Instrument 10 may also be used to simultaneously measure and scribe lines on a 45 degree angle by inverting instrument 10 such that outer ends 24 and 30 of legs 20 and 22, respectively, rest on an edge of the T-square or drafting horizontal bar and inner edges 26 and 32 form 45 degree angles to that edge of the T-square or drafting horizontal bar, and measuring and scribing the desired line along either of those inner edges. It will be understood that any of the edges of body 12 of instrument 10 may be used to scribe lines in either graphite or ink, since the raising of lower face 16 above the drafting surface on glide points 40 prevents the capillary flow of ink between the drafting surface and lower face 16.

The foregoing detailed description of the preferred embodiment of the drafting instrument of the invention is illustrative, and not for purposes of limitation. The drafting instrument of the invention is susceptible to various modifications and alternative embodiments without departing from the scope and spirit of the invention as claimed.

What is claimed is:

1. A method of simultaneously measuring and scribing ink lines on a substantially planar surface at angle of 0 degrees, 45 degrees, and 90 degrees relative to a reference line on such substantially planar surface, comprising the steps of placing an elongate substantially planar alignment device having at least one elongate straight edge on the surface to receive such ink lines in moveable relation to such surface with such straight edge in parallel alignment with the reference line on such surface;

placing against said straight edge on said alignment device the outer edge of one leg of a substantially planar drafting instrument with an upper face and a lower face, having two legs of equal length and width interconnected at their proximal ends in perpendicular relation, each leg with an inner edge of shorter length than its outer edge and inclined at an angle of 45 degrees and its distal end and each leg beveled along its inner edge and its proximal end from its upper face to its lower face, and having a first ruled scale disposed along the inner edge of one leg and a second ruled scale disposed along the inner edge of the other leg with a zero point of each scale coincident at the intersection of the inner edge of such two legs;

suspending the lower face of such drafting instrument parallel to and slightly above such surface upon a plurality of glide points interconnected to and extending outwardly a short distance from such lower face of such drafting instrument;

positioning such alignment device and such drafting instrument upon such surface such that the starting point of an ink line to be simultaneously measured and scribed thereon at an angle of 0 degrees relative to such reference line lies directly under the intersection of the inner edges of such legs of such drafting instrument, being the zero point of both scales disposed thereon;

placing the point of an inking instrument upon such surface at said starting point and drawing said point across such surface along the inner edge of the leg of such drafting instrument parallel to the straight edge of such alignment device to the point on the ruled scale disposed therealong corresponding to the desired length of such line, thereby simultaneously measuring and scribing an ink line at 0 degrees to such reference line;

positioning such alignment device and such drafting instrument upon such surface such that the starting point of an ink line to be simultaneously measured and scribed thereon at an angle of 90 degrees relative to such reference line lies directly under the intersection of the inner edges of such legs of such drafting instrument, being the zero point of both scales disposed thereon;

placing the point of an inking instrument upon such surface at said starting point and drawing said point across such surface along the inner edge of the leg of such drafting instrument perpendicular to the straight edge of such alignment device to the point on the ruled scale disposed therealong corresponding to the desired length of such line, thereby simultaneously measuring and scribing an ink line at 90 degrees to such reference line;

rotating such drafting instrument about an axis of rotation perpendicular to such surface and placing the distal end of each leg thereof against the straight edge of such alignment device, thereby positioning the edges of both legs at an angle of 45 degrees relative to such straight edge and to such reference line;

positioning such alignment device and such drafting instrument upon such surface each that the starting point of an ink line to be simultaneously measured and scribed thereon at an angle of 45 degrees relative to such reference line lies directly under the intersection of the inner edges of such legs of such drafting instrument, being the zero point of both scales disposed thereon;

placing the point of an inking instrument upon such surface at said starting point and drawing said point across such surface along the inner edge of either leg of such drafting instrument at either of the 45 degree angles formed relative to the straight edge of such alignment device to the point on the ruled scale disposed along the selected leg corresponding to the desired length of such line, thereby simultaneously measuring and scribing an ink line at 45 degrees to such reference line.

2. The method of claim 1, wherein the drafting instrument further has a handle interconnected to and extending outwardly from the upper face of such drafting instrument near the interconnection between the proximal ends of the legs thereof, and wherein the steps of positioning and rotating such drafting instrument are performed by grasping such handle and positioning or rotating such drafting instrument by manipulating such handle.

3. A method of simultaneously measuring and scribing a plurality of precisely formed ink lines of selected length on a substantially planar surface at selected angles of 0 degrees, 90 degrees, and 45 degrees relative to a reference line on such surface, using a single substantially planar drafting instrument with a body having an upper face and a lower face, having two legs of equal length and width interconnected at their proximal ends in perpendicular relation, each leg with an inner edge of shorter length than its outer edge and being inclined at an angle of 45 degrees at its distal end and each leg beveled along its inner edge and its distal end from its upper face to its lower face, and having a first ruled scale disposed along the inner edge of one leg and a second ruled scale disposed along the inner edge of the other leg with a zero point of each scale coincident at the intersection of the inner edge of such two legs, such drafting instrument further having a plurality of glide points interconnected to and extending outwardly a short equal distance from the lower face of the body, and such drafting instrument still further having a handle interconnected to and extending outwardly from the upper face of the body near the interconnection between the legs thereof, comprising the steps of placing an elongate substantially planar alignment device having at least one elongate straight edge on the surface to receive such ink lines in moveable relation to such surface with such straight edge in parallel alignment with the reference line on such surface;

placing the substantially planar drafting instrument upon said surface with the glide points extending from the lower face of the body of the drafting instrument supporting the body of the drafting instrument above said surface, and with the outer edge of one leg of the body of the drafting instrument against said straight edge of said alignment device;

positioning said alignment device and the drafting instrument upon said surface such that the starting point of an ink line to be simultaneously measured and scribed thereon at an angle of 0 degrees relative to the reference line lies directly under the intersection of the inner edges of the legs of the body of the drafting instrument, at the zero point of both scales disposed thereon;

placing the point of an inking instrument upon said surface at said starting point and drawing said point across said surface along the inner edge of the leg of the body of the drafting instrument parallel to the straight edge of said alignment device to the point on the ruled scale disposed therealong corresponding to the desired length of such line, thereby simultaneously measuring and scribing an ink line at 0 degrees to the reference line;

positioning said alignment device and the drafting instrument upon said surface such that the starting point of an ink line to be simultaneously measured and scribed thereon at an angle of 90 degrees relative to the reference line lies directly under the intersection of the inner edges of such legs of the body of the drafting instrument, at the zero point of both scales disposed thereon;

placing the point of an inking instrument upon said surface at said starting point and drawing said point across said surface along the inner edge of the leg of the body of the drafting instrument perpendicular to the straight edge of said alignment device to the point on the ruled scale disposed therealong corresponding to the desired length of such line, thereby simultaneously measuring and scribing an ink line at 90 degrees to the reference line;

rotating the drafting instrument about an axis of rotation perpendicular to said surface and placing the distal end of each leg of the body of the drafting instrument against the straight edge of said alignment device, thereby positioning the edges of both legs at an angle of 45 degrees relative to such straight edge and to the reference line;

positioning said alignment device and the drafting instrument upon said surface such that the starting point of an ink line to be simultaneously measured and scribed thereon at an angle of 45 degrees relative to the reference line lines directly under the intersection of the inner edges of such legs of the body of the drafting instrument, at the zero point of both scales disposed thereon;

placing the point of an inking instrument upon said surface at said starting point and drawing said point across said surface along the inner edge of either leg of the body of the drafting instrument at either of the 45 degree angles formed relative to the straight edge of said alignment device to the point on the ruled scale disposed along the selected leg corresponding to the desired length of such line, thereby simultaneously measuring and scribing an ink line at 45 degrees to the reference line.

4. The method of claim 3, wherein the steps of positioning and rotating the substantially planar drafting instrument are performed by grasping the handle of the drafting instrument and positioning or rotating such drafting instrument by manipulating such handle.

* * * * *